US006866543B2

(12) United States Patent
Chen et al.

(10) Patent No.: US 6,866,543 B2
(45) Date of Patent: Mar. 15, 2005

(54) MODULE TYPE MINI BNC CONNECTOR

(75) Inventors: Sung-Wen Chen, Hsin-Tien (TW); Tung-Liang Huang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 10/409,451

(22) Filed: Apr. 9, 2003

(65) Prior Publication Data

US 2004/0203283 A1 Oct. 14, 2004

(51) Int. Cl.[7] ..... H01R 9/05
(52) U.S. Cl. ..... 439/578; 439/579; 439/541.5
(58) Field of Search ..... 439/578, 579, 439/188, 581–582, 541.5, 620

(56) References Cited

U.S. PATENT DOCUMENTS 4,206,963 A * 6/1980 English et al. ..... 439/581
5,122,063 A * 6/1992 Cooper ..... 439/13
5,413,502 A * 5/1995 Wang ..... 439/551
5,413,504 A * 5/1995 Kloecker et al. ..... 439/620
5,803,757 A * 9/1998 Wang ..... 439/188
5,971,770 A * 10/1999 Richmond ..... 439/63
6,036,545 A * 3/2000 Caviness et al. ..... 439/620
6,648,684 B2 * 11/2003 Tang ..... 439/582
6,676,443 B1 * 1/2004 Wang ..... 439/541.5
6,679,728 B1 * 1/2004 Huang et al. ..... 439/579
2003/0190840 A1 * 10/2003 Fegley et al. ..... 439/578
2004/0029433 A1 * 2/2004 Lee et al. ..... 439/445

* cited by examiner

*Primary Examiner*—Michael C. Zarroli
(74) *Attorney, Agent, or Firm*—Troxell Law Office PLLC

(57) ABSTRACT

A module type mini BNC connector includes a metal outer casing, a front insulator, a terminal and a rear insulator. The metal outer casing is provided with a locating cylinder and a joining chamber with an opening communicates with the inner side of the locating cylinder. The front insulator is fitted in the locating cylinder with a piercing hole. The terminal has a front section and a rear section with the front section being joined to the piercing hole with a tail end extending to the joining chamber and the rear section being joined to the tail end. The rear insulator with a piercing hole is joined to the rear section of the terminal and is fitted to an inner side of the joining chamber at the opening thereof.

16 Claims, 8 Drawing Sheets

MODULE TYPE MINI BNC CONNECTOR

BACKGROUND OF THE INVENTION

1. Field of the Invention

The present invention relates to a module type mini BNC connector, and particularly to a mini sized and easily fabricated module type BNC connector.

2. Description of Related Art

In order to enhance signal transmission quality of the BNC connector with metal outer casing, the applicant has filed an invention in Taiwan with Application No. 91206496 and in U.S. with application Ser. No. 10/173,462, entitled BNC CONNECTOR WITH ALL METAL OUTER CASING. The prior art basically has a metal cover is joined to an outer casing at the lower end thereof to constitute a space for receiving the BNC connector and the lead wires extending from the rear side of the BNC connector. Hence, the power loss rate of the BNC connector during the signal being transmitted can be reduced and the electromagnetic wave interference generated by the foreign electronic parts can be resisted so as to enhance the quality of the transmitted signal.

However, the preceding BNC connectors are large sized but it is a trend that smaller sized BNC connectors are needed. In order to comply with the trend, the present inventor further has filed a Taiwanese application, which was assigned Application No. 91217859, and a U.S. patent application entitled "MINI BNC CONNECTOR". The mini BNC connector is provided with double casings so that it is capable of providing better signal transmission quality and being fabricated more conveniently.

Currently used various module type mini BNC connectors as shown in FIGS. 1A, 1B, 1C, 1D and 1E provide casings thereof are composed of front casings 30, 32, 34, 36, 38 and rear casings 31, 33, 35, 37, 39. The front casings 30, 32 at the external parts thereof have an arched shape and the front casings 34, 36, 38 at the external parts thereof have a square shape respectively. The rear casings 31, 33, 35, 37 at external parts thereof have screw threads 311, 331, 351, 371 respectively and the real casings 31, 35 at the external parts thereof have ring plates 312, 352 respectively behind the screw threads 311, 351.

As the foregoing, the conventional module type mini BNC connector adopts a two piece combined outer casing and although it is easy for the terminals and the insulators to mount in the outer casing, the two piece parts of the outer casing have to be fabricated independently before being joined to each other and more material cost and longer working time are needed. Further, the front and the rear casings have a very tiny size respectively and it is hard to be assembled so that it is easy to result in a change of electrical performance of the respective terminal and become defective product in case of occurring a slight deviation of position. Accordingly, it is time consuming and requires more labor with more serious defect rate so that higher production cost has to be spent.

SUMMARY OF THE INVENTION

A primary object of the present invention is to provide a module type mini BNC connector, which is possible to enhance quality of signal transmission and to be fabricated easily with less labor, production time and production cost.

BRIEF DESCRIPTION OF THE DRAWINGS

The present invention can be more fully understood by reference to the following description and accompanying drawing, in which.

DETAILED DESCRIPTION OF THE PREFERRED EMBODIMENTS

Figure 1C:
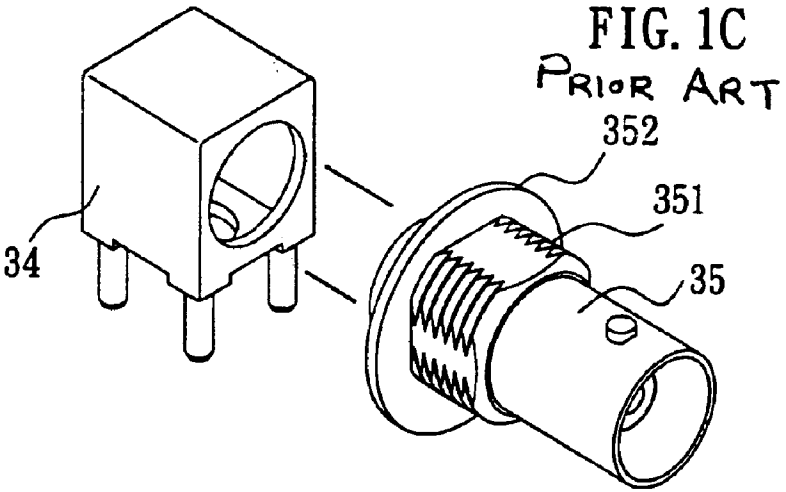
FIG. 1C PRIOR ART
FIGS. 1A, 1B, 1C, 1D and 1E are perspective views of various conventional module type of mini BNC connector.
Figure 1A:
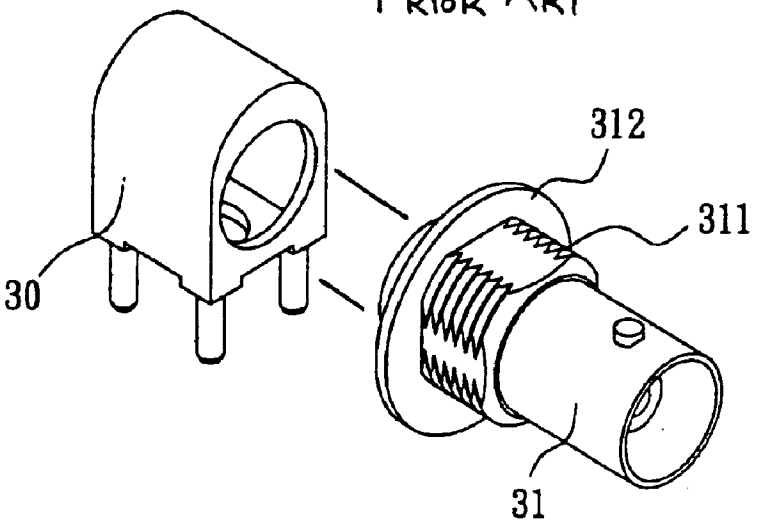
FIG. 1A PRIOR ART
Figure 1B:
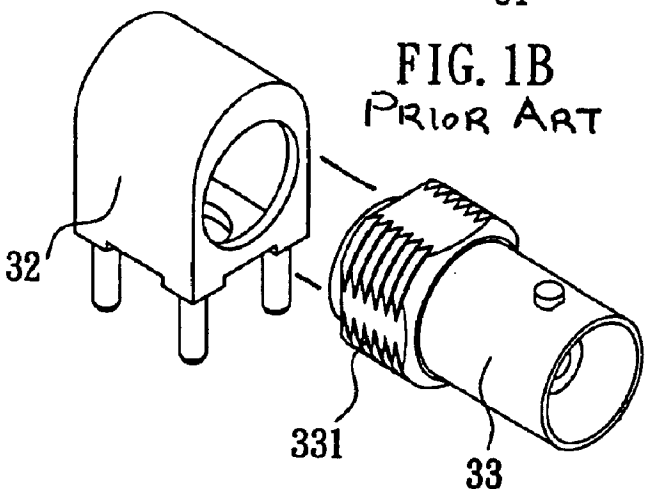
FIG. 1B PRIOR ART
Figure 1E:
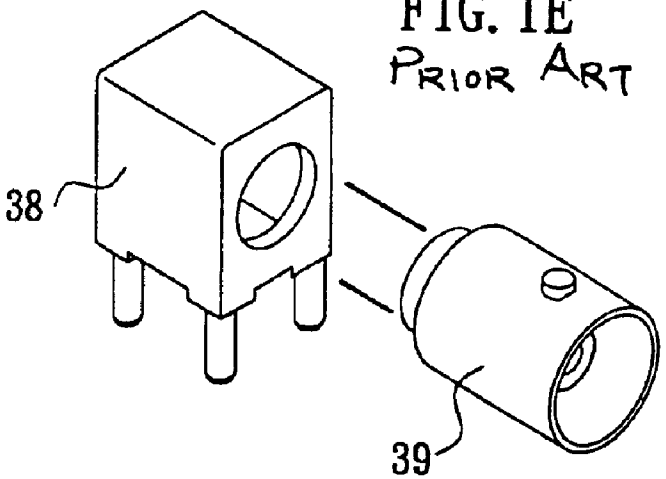
FIG. 1E PRIOR ART
Figure 1D:
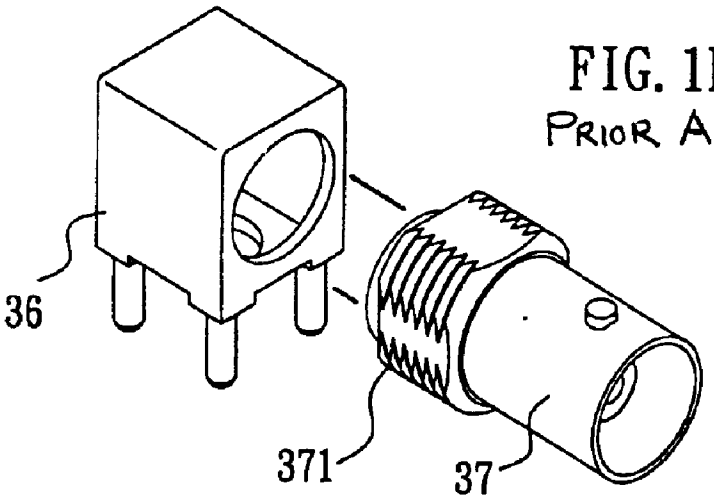
FIG. 1D PRIOR ART
Figure 2A:
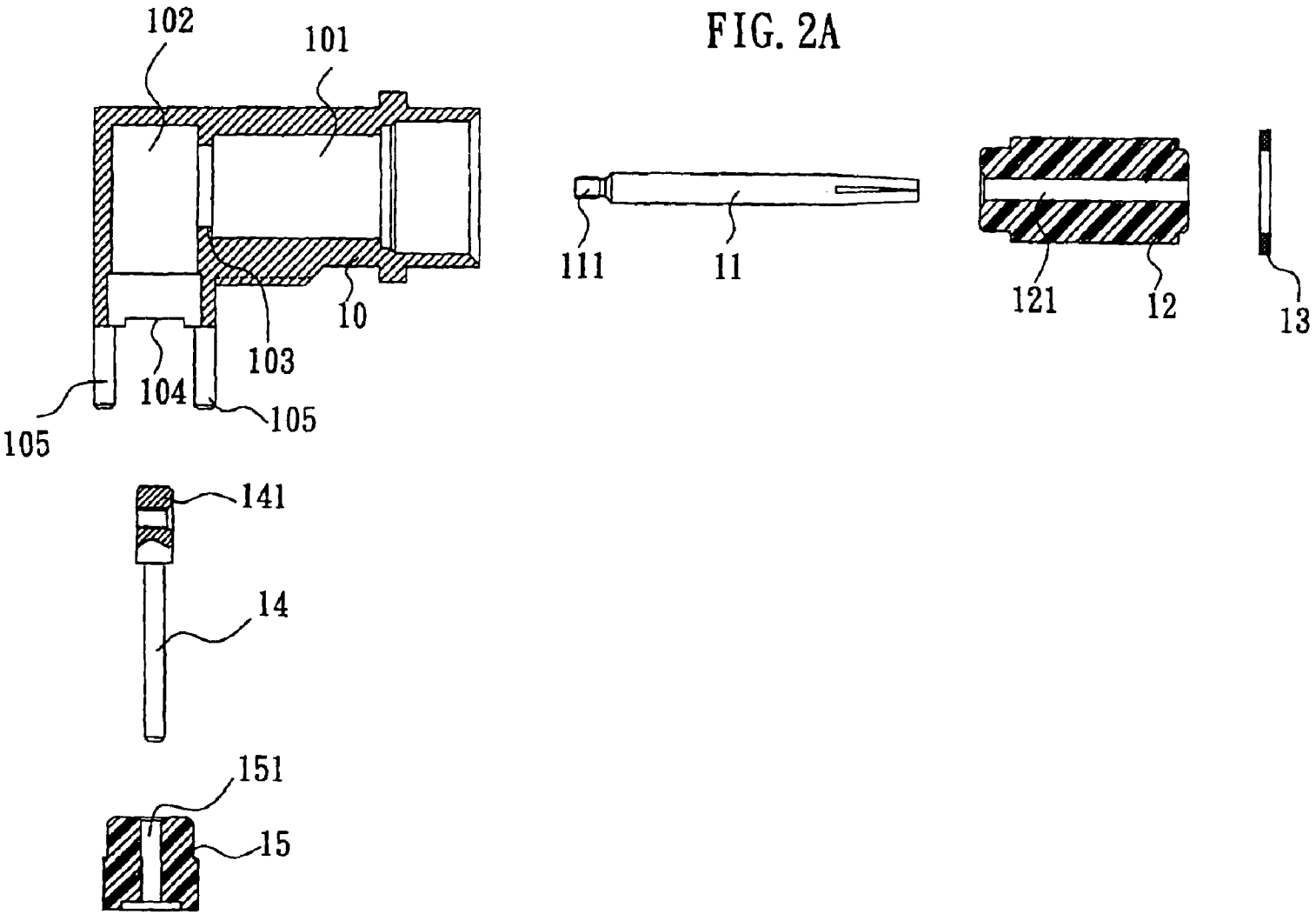
FIG. 2A is a disassembled sectional view of module type mini BNC connector according to the present invention.

Referring to FIG. 2A, a module type mini BNC connector of the present invention in a first embodiment thereof has a metal outer casing 10 and the metal outer casing 10 further has a locating cylinder 101 and a joining chamber 102 communicating with an inner end of the locating cylinder 101. The locating cylinder 101 at the inner thereof is inserted with a terminal front section 11, a front insulator 12 and a packing ring 13 respectively. The locating cylinder 101 at the inner end thereof provides a rib 103 to fix the insulator 12 in place. The front insulator 12 has an outer diameter slightly smaller than that of the locating cylinder 101 and the front insulator 12 at the upper end thereof is surrounded and fits with the packing ring 13 so that the front insulator 12 can be fixedly attached to the inner side of the locating cylinder 101. The front insulator 12 has a piercing hole 121 to engage with a tail end 111 of the front section 11 so that the front section 11 can be fixedly attached to the locating cylinder 101 at inner side thereof. The front section 11 at the tail section 111 thereof extends to the joining chamber 102. In the embodiment, the tail section 111 of the front section 11 is provided with screw threads to engage with corresponding threaded screw hole of joining part 141 at the terminal rear section 14 so that the front section 11 and the rear section 14 can connect with each other. A rear insulator 15 is provided with a piercing hole 151 for joining the rear section 14 such that the rear section 14 can be fitted into an opening 104 of the joining chamber 102 to constitute a state of being fixed and extending outward the joining chamber 102. The outer casing 10 has connecting pins 105 at the outer side of the joining chamber 102 and the connecting pins 105 is capable of being inserted into engaging holes of the circuit board.

The rear terminal section 14 received in the outer casing 10 can reduce power loss during the BNC connector transmitting signal and can prevent the transmitted signal of the BNC connector from being interfered by magnetic wave emitted from electronic parts at outer side of the BNC connector so that it is capable of enhancing signal transmission quality of the BNC connector effectively. Further, the metal outer casing 10 is integrally made without the need of joining a metal cover additionally as done in the previously mentioned Taiwanese and U.S. patent applications or the outer casing being joined by two pieces as the conventional module type mini BNC connector does. Hence, it is much more convenient for the metal outer casing is fabricated.

While the mini BNC connector of the present invention is assembled, the front section 11 is joined to the rear section 14 of the terminal first and then the rear insulator 15, the front insulators 12 and the packing ring 13 are assembled. Hence, the front section 11 and the rear section 14 are very easy to be set up in the outer casing 10.

Figure 2D:
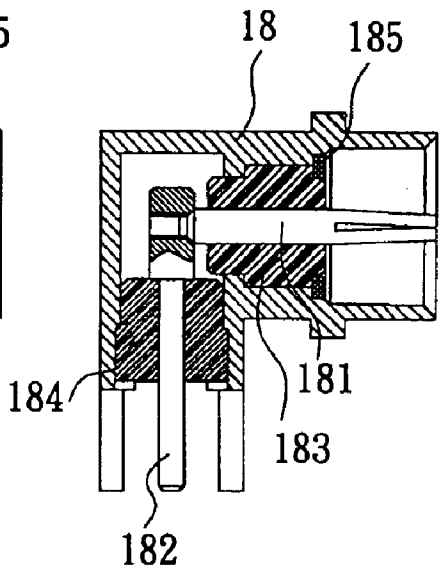
FIGS. 2B, 2C and 2D are sectional view of module type mini BNC connector according to the present invention illustrating different shapes of outer shells.
Figure 2C:
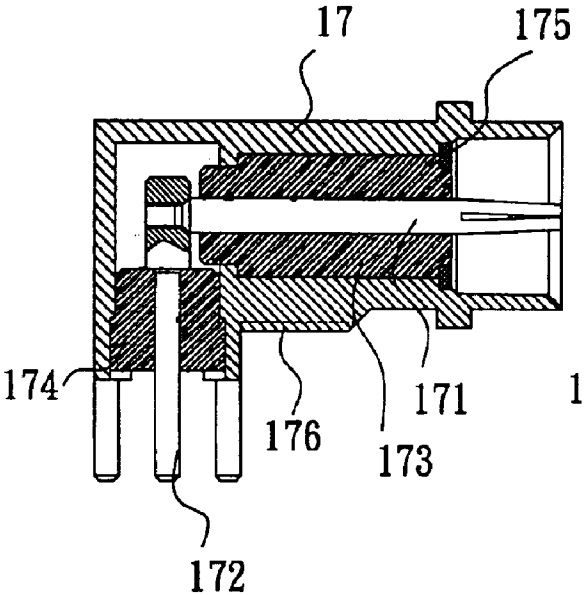
Figure 2B:
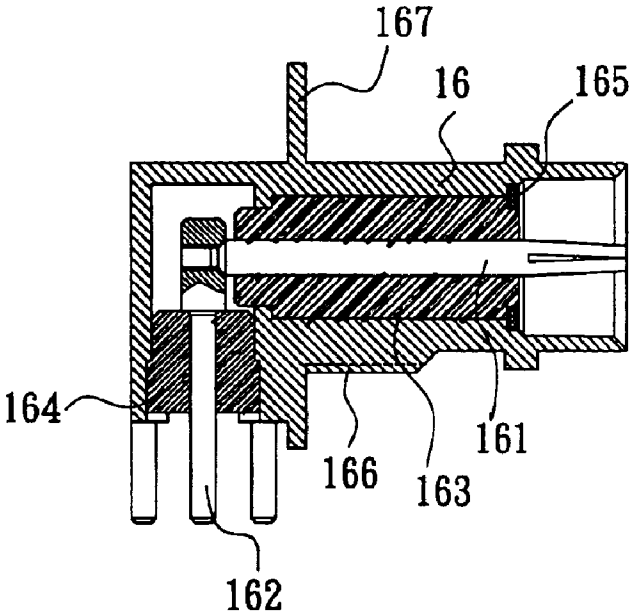

With reference to FIGS. 2B, 2C and 2D, the module type mini connector in the preceding embodiment of the present invention is provided with different shapes. It can be seen in the figures that the terminals at front sections 161, 171, 181 and rear sections 162, 172, 182 thereof, the front insulators 163, 173, 183, the rear insulators 164, 174, 184 and packing rings 165, 175, 185 have a shape and a length thereof respectively to accommodate different shapes of outer casings 16, 17, 18. It is noted that the outer casing 16 at the outer side thereof has screw threads 166 and an annular plate 167 and the outer casing 17 at the outer side thereof has screw threads 176.

Figures 3A, 3B:
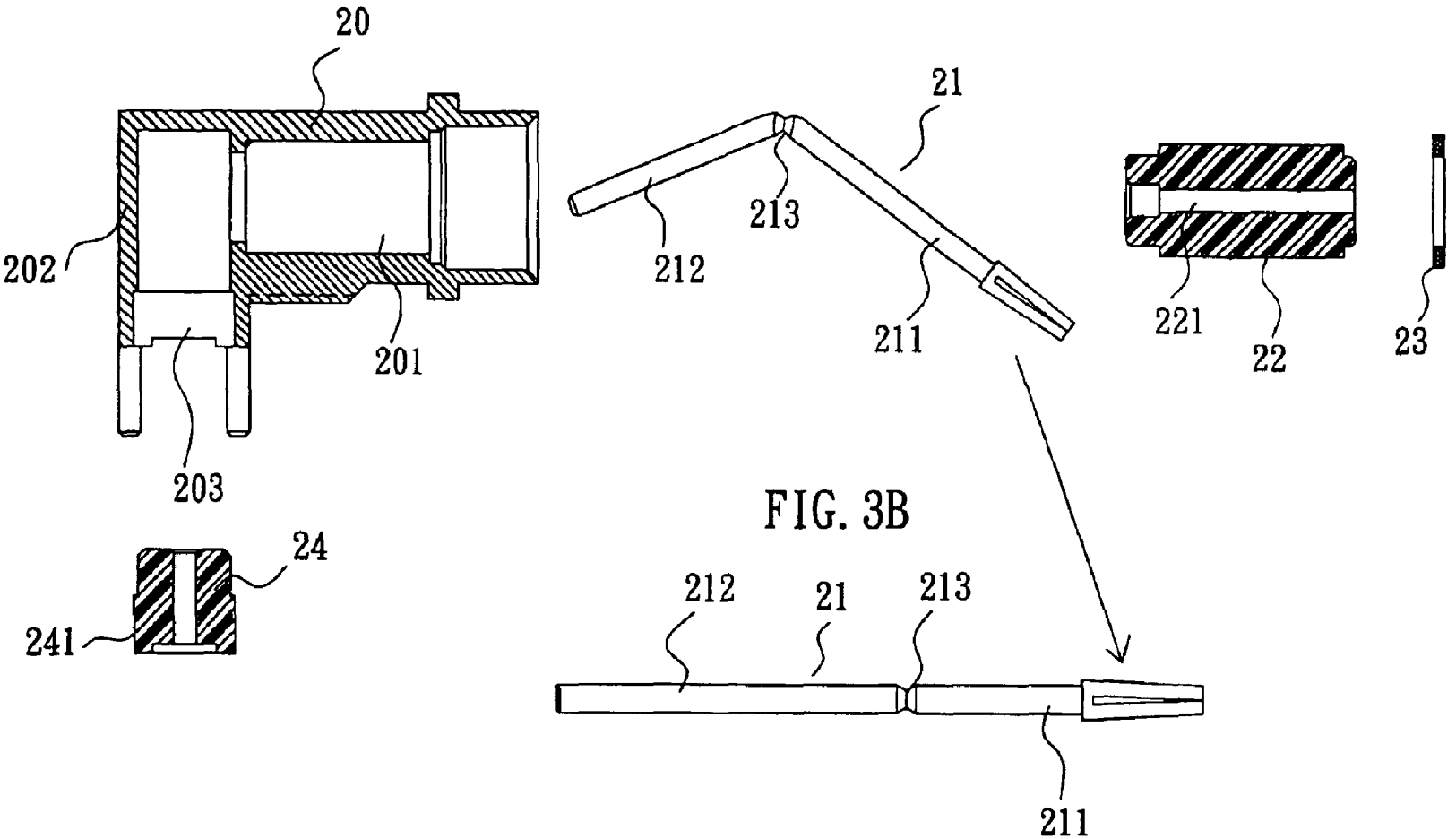
FIG. 3A is a disassembled sectional view of the module type mini BNC connector of the present invention in another embodiment thereof.
FIG. 3B is a sectional view of the module type mini BNC connector of the present invention in the embodiment shown in FIG. 3A.
Figure 3E:
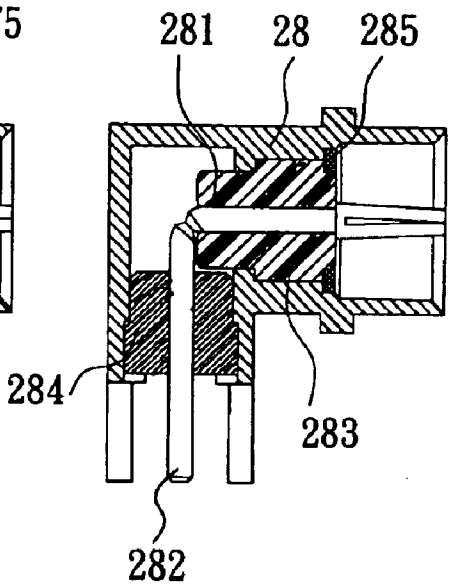
FIGS. 3C, 3D and 3E are sectional view of module type mini BNC connector according to the present invention in embodiment shown in FIG. 3A.

With reference to FIGS. 3A and 3B, another embodiment of the module type mini BNC connector are illustrated. Comparing to FIG. 2A, the module type mini BNC connector of the second embodiment is provided with an outer casing, the front insulator, the rear insulator and the packing ring thereof similar to the first embodiment except engaging part at the front section and the rear section of the terminal.

With reference to FIGS. 3A and 3B again, the terminal 21 in the second embodiment has a front section 211 and a rear section 212 and an annual recess 213 surrounding the terminal 21 between the front section 211 and the rear section 212 to facilitate the bent position being fixed and the rear section 212 being bent 90°.

While the module type mini BNC connector of the preceding embodiment is being assembled, the rear section 212 is slightly bent to pass through a locating cylinder 201 of the outer casing 20 and extend outward the opening 203 of the joining chamber 202 and then is bent 90° at the annular recess 213. Further, the rear insulator 24 at the piercing hole 241 thereof is joined to the rear section 212 of the terminal 21 and inserted into the joining chamber 202 before the opening 203 is closed. Then, the front insulator 22 at the piercing hole 221 thereof is joined to the front section 211 of the terminal 21 and the front insulator 22 is fixed in the locating cylinder 201 with the packing ring 23 to complete the assembling job for the module type mini BNC connector.

Figure 3D:
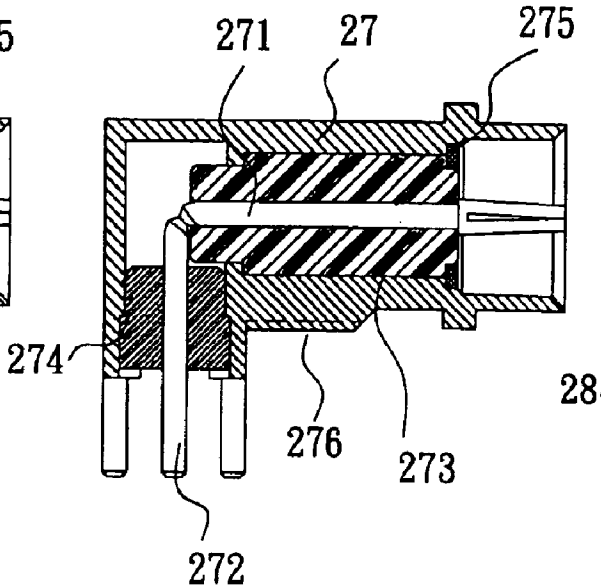
Figure 3C:
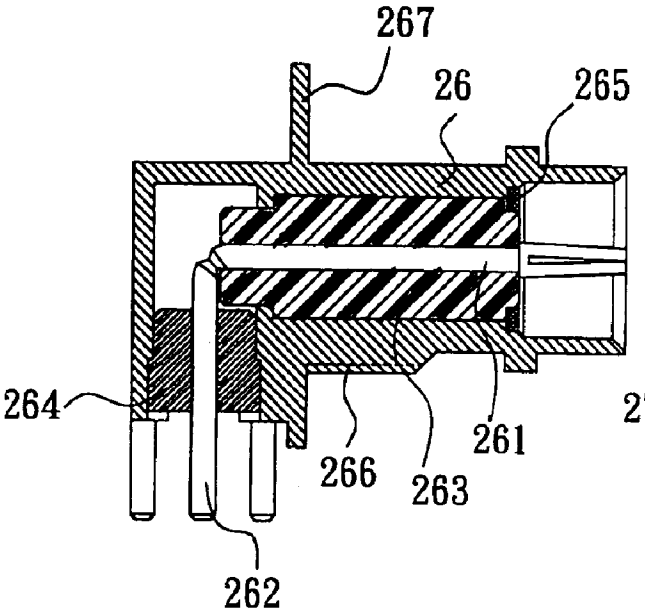
Figure 4B:
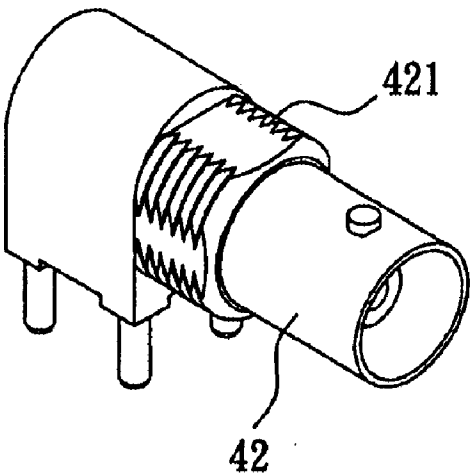
FIGS. 4A, 4B, 4C, 4D, 4E and 4F are perspective views illustrating the module type mini BNC connector according the present invention in a further embodiment thereof.
Figure 4C:
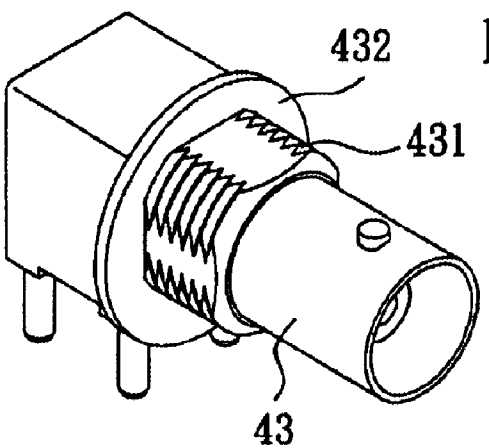
Figure 4A:
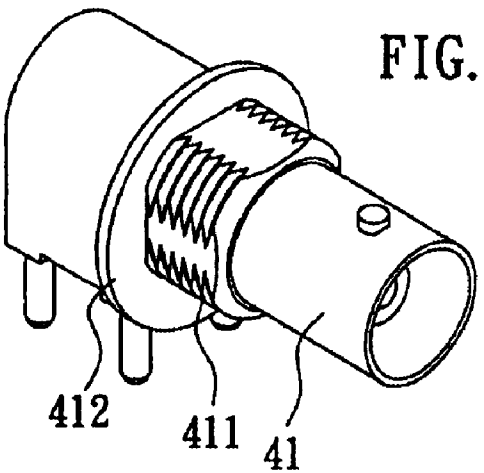
Figure 4F:
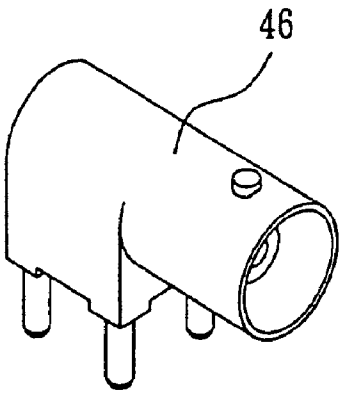
Figure 4D:
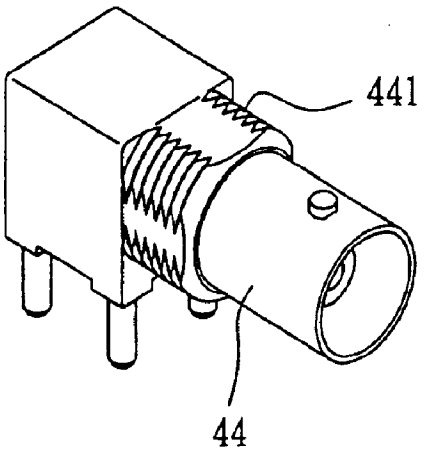
Figure 4E:
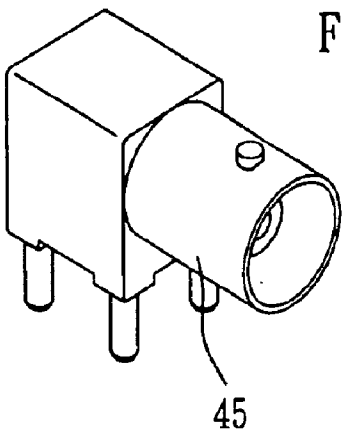

With reference to FIGS. 3C, 3D and 3D, the module type mini connector in the preceding embodiment of the present invention is provided with different shapes. It can be seen in the figures that the terminals at front sections 261, 271, 281 and rear sections 262, 272, 282 thereof, the front insulators 263, 273, 283, the rear insulators 264, 274, 284 and packing rings 265, 275, 285 have a shape and a length thereof to accommodate different shapes of outer casings 26, 27, 28 respectively. It is noted that the outer casing 26 at the outer side thereof has screw threads 266 and an annular plate 267 and the outer casing 27 at the outer side thereof has screw threads 276.

The front section and the rear section of the terminal according to the present invention are utilized for specially joining design to allow the front section and the rear section of the terminal being capable of bending 90° in a limitation of very small space without occurring distortion and deformation. Hence, signal transmission lines can be bent smoothly to maintain a better quality for signal transmission and it leads to the module type mini BNC connector being assembled and fabricated with facility.

It is appreciated that different module type mini BNC connectors of the present invention provide different shapes of outer casings thereof in configuration for meeting various usages. For instance, FIGS. 4A, 4B, 4C, 4D, 4E and 4F show that outer casings 43, 44, 45 at external parts thereof have a square shape at a side thereof respectively and outer casings 41, 42, 46 at external parts thereof have an arched shape at a side thereof respectively. Outer casings 41, 42, 43, 44 at external parts thereof have screw threads 411, 421, 431, 441 respectively and the outer casings 41, 43 at the external parts thereof have ring plates 412, 432 behind the screw threads 411, 431 respectively.

While the invention has been described with reference to preferred embodiments thereof, it is to be understood that modifications or variations may be easily made without departing from the spirit of this invention, which is defined by the appended claims.

What is claimed is:

1. A module type mini BNC connector, comprising:

a metal outer casing having a locating cylinder and a joining chamber with an opening communicating with an inner side of the cylinder;

a front insulator inserted in the locating cylinder and having a piercing hole;

a terminal having a front section and a rear section, the front section being joined to the piercing hole with a tail end extending to the joining chamber and the rear section being joined to the tail end; and a rear insulator with a piercing hole, being joined to the rear section of the terminal and being fitted to an inner side of the opening of the joining chamber, wherein the front insulator at an upper end thereof is fitted with a surrounding packing ring for the front insulator being fixed in the locating cylinder.

2. The module type mini BNC connector according to claim 1, wherein the front section and the rear section of the terminal are formed as an integral piece.

3. The module type mini BNC connector according to claim 1, wherein the locating cylinder has an inner rib to fix the front insulator in place.

4. The module type mini BNC connector according to claim 1, wherein the outer casing at an external part thereof is provided with a shape of cube at a side thereof.

5. The module type mini BNC connector according to claim 1, wherein outer casing at an external part thereof is provided with an arched shape at a side thereof.

6. The module type mini BNC connector according to claim 2, wherein a surrounded annular recess between the front section and the rear section.

7. The module type mini BNC connector according to claim 4, wherein the outer casing at an external part thereof has screw threads.

8. The module type mini BNC connector according to claim 5, wherein the outer casing at an external part thereof has screw threads.

9. The module type mini BNC connector according to claim 7, wherein outer casing at an external part thereof has a ring plate behind the screw threads.

10. A module type mini BNC connector, comprising:

a metal outer casing having a locating cylinder and a joining chamber with an opening communicating with an inner side of the cylinder;

a front insulator inserted in the locating cylinder and having a piercing hole;

a terminal having a front section and a rear section, the front section being joined to the piercing hole with a tail end extending to the joining chamber and the rear section being joined to the tail end; and a rear insulator with a piercing hole, being joined to the rear section of the terminal and being fitted to an inner side of the opening of the joining chamber, wherein the front section and the rear section of the terminal are formed as an integral piece, and wherein the terminal includes a surrounded annular recess between the front section and the rear section.

11. The module type mini BNC connector according to claim 10, wherein the locating cylinder has an inner rib to fix the front insulator in place.

12. The module type mini BNC connector according to claim 10, wherein the outer casing at an external part thereof is provided with a shape of cube at a side thereof.

13. The module type mini BNC connector according to claim 10, wherein outer casing at an external part thereof is provided with an arched shape at a side thereof.

14. The module type mini BNC connector according to claim 12, wherein the outer casing at an external part thereof has screw threads.

15. The module type mini BNC connector according to claim 13, wherein the outer casing at an external part thereof has screw threads.

16. The module type mini BNC connector according to claim 14, wherein outer casing at an external part thereof has a ring plate behind the screw threads.

* * * * *